United States Patent [19]

Schwaab et al.

[11] 4,104,968

[45] Aug. 8, 1978

[54] CLAMPING DEVICE FOR FLEXIBLE PRINTING PLATES

[75] Inventors: Manfred Schwaab, Lu-Oggersheim; Helmut Puschnerat, Worms; Fritz Kluzik; Manfred Jünger, both of Frankenthal; Ernst Wilding, Grünstadt, all of Fed. Rep. of Germany; Hans Tittes, deceased, late of Frankenthal, Fed. Rep. of Germany, by Marga Tittes, Hans-Ulrich Tittes, Gerlach Stephan Tittes, Axel Michael Tittes, heirs

[73] Assignee: Albert-Frankenthal AG, Frankenthal, Fed. Rep. of Germany

[21] Appl. No.: 692,265

[22] Filed: Jun. 3, 1976

[51] Int. Cl.[2] ..... B41F 27/12

[52] U.S. Cl. ..... 101/415.1

[58] Field of Search ..... 101/378, 415.1

[56] References Cited

U.S. PATENT DOCUMENTS

| | | | |
|---|---|---|---|
| 2,309,161 | 1/1943 | Breman et al. | 101/415.1 |
| 3,410,211 | 11/1968 | Grunig | 101/415.1 |
| 3,626,848 | 12/1971 | Tafel | 101/415.1 |
| 3,757,691 | 9/1973 | Etchell | 101/415.1 |

FOREIGN PATENT DOCUMENTS

| | | | |
|---|---|---|---|
| 2,048,141 | 5/1971 | Fed. Rep. of Germany | 101/415.1 |
| 2,334,127 | 1/1975 | Fed. Rep. of Germany | 101/415.1 |
| 1,231,188 | 5/1971 | United Kingdom | 101/415.1 |

*Primary Examiner*—William Pieprz
*Attorney, Agent, or Firm*—Allison C. Collard

[57] ABSTRACT

A device for clamping flexible printing plates onto the plate cylinder of rotary printing presses, wherein the plate cylinder has a concentric groove formed in its surface, the groove walls extending at an acute angle into the surface of the plate cylinder to define a pair of hook-like edges at the groove opening for receiving the correspondingly hook-like bent ends of the printing plate. A spindle is pivotably disposed in the groove having an axis concentric with the groove. At least one flange spring is supported on a first side of the spindle which faces a first hook-like wall edge. A clamping element is formed at one the end of the spring for engaging the front end of the printing plate against one of the hook-like groove edges. A bar disposed on the opposite side of the spindle axis and mounted to the spindle, the bar extending into the plate cylinder surface for receiving the hook-like bent rear end of the printing plate. The bar is directed toward the printing plate front end, so that when the spindle is pivoted on its axis, the extending end of the bar will engage the clamping element and urge it against the first hook-like edge of the groove to secure both ends of the printing plate.

2 Claims, 3 Drawing Figures

CLAMPING DEVICE FOR FLEXIBLE PRINTING PLATES

The present invention relates to a device for clamping flexible printing plates onto the plate cylinder of rotary printing presses. More specifically, the present invention relates to a clamping device preferably for offset printing wherein a rotatable spindle is mounted in a concentric groove, whereby the grooved walls extend in an acute angle into the surface of the plate cylinder. The hook-like edge or bent front end of the printing plate is attached within these grooved walls. These clamping devices permit the clamping of one as well as a plurality of printing plates on the circumference as well as across the width of the plate cylinder, whereby each plate may be separately mounted or removed without influencing the other plates.

Known clamping devices of this type (for example, German laid open patent 21 26 941) require the addition of a filler, a slide, or wedge elements and are therefore too complicated in their structure and too hard to handle during the mounting of the printing plates. It is therefore an object of the subject invention to improve the aforementioned clamping devices by providing simple, easily manageable and easily exchangeable clamping elements.

In accordance with the invention, a spring or row of springs are mounted on the side of the spindle axis of the spindle which faces the attachment wall edge and which supports a clamping element positioned between the plate cylinder surface. On the opposite side of the spindle axis of the spindle, a bar is mounted extending into the plate cylinder surface for attaching a hook-like bent printing plate and which is bent toward the front end of the printing plate.

The effects obtained when the spindle is twisted in the clamping direction are explained in detail in the following specification. In the end result, an effective connection is obtained which assures a secure clamping of the front plate end and an exact clamping of the rear plate end.

Other objects and features of the present invention will become apparent from the following detailed description when taken in connection with the accompanying drawing which discloses an embodiment of the invention. It is to be understood that the drawing is designed for the purpose of illustration only, and is not intended as a definition of the limits and scope of the invention disclosed.

In the drawing, wherein similar reference numerals denote similar elements throughout the several views.

Figure 1:
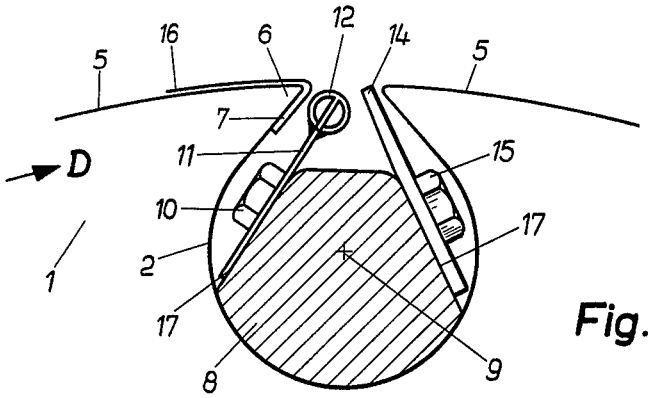
FIG. 1 shows the attachment of the printing plate front end.
Figure 2:
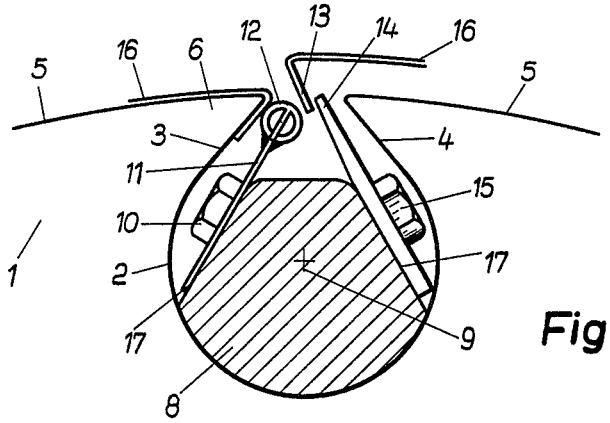
FIG. 2 shows the attachment of the printing plate rear end.
Figure 3:
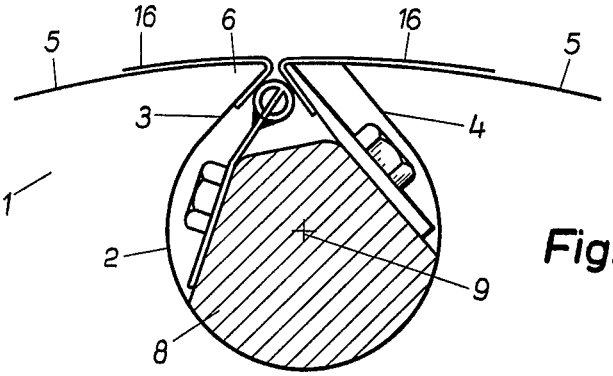
FIG. 3 shows the entire clamping of both plate ends.

Referring to FIGS. 1–3, there is shown a concentric groove or cavity 2 formed in plate cylinder 1 extending along the total length of the plate cylinder. Walls 3 and 4 of groove 2 extend in an acute angle into surface 5 of the plate cylinder. The hook-like front end 7 of the printing plate is mounted over the hook-like wall edge 6, as shown in FIG. 1. A spindle 8 which is rotatable around its associated axis 9 is provided in groove 2. A plurality of leaf springs 11 are mounted under bolts 10 on the axial side of spindle 8 which faces attachment wall edge 6, so that these leaf springs support a continuous clamping element 12 which is maintained inwardly of the plate cylinder surface. On the opposite axial side of spindle 8, a bar 14 is mounted at mounting 15 extending into the plate cylinder surface for attaching a mirror-inverted hook-like bend of printing plate rear end 13 which is bent toward printing plate front end 7, as can be seen in FIG. 2. In FIG. 2, spindle 8 has been turned somewhat in the counter clockwise direction with respect to the position shown in FIG. 1. Thereby, clamping element 12 presses against front end 7 of the printing plate so that the end cannot be disengaged while flexible printing plate 16 is mounted around the plate cylinder surface.

FIG. 3 shows the common clamping of printing plate front end 7, printing plate rear end 13 and clamping element 12 between bar 14 and attachment wall edge 6 by a further twisting of spindle 8 in a counter clockwise direction.

The plate cylinder in the embodiment shown is preferably rotated in arrow direction D of FIG. 1. For a convenient flanging of spring 11 and bar 14 is removable at mounting 15. Special abutments for fixing the sides are not shown because they are known. Essentially, clamping element 12 has a circular cross section.

While only a single embodiment of the present invention has been shown and described, it will be obvious to those skilled in the art that many changes and modifications may be made thereunto without departing from the spirit and scope of the invention.

What is claimed is:

1. A device for clamping flexible printing plates onto the plate cylinder of rotary printing presses, said plate cylinder having a generally cylindrical, axially-extending groove formed in its surface whereby the groove walls extend at an acute angle into the surface of the plate cylinder defining a pair of hook-like edges at the groove opening for receiving the correspondingly hook-like bent ends of the printing plate, comprising:

a spindle pivotably disposed in said groove having an axis concentric with the groove, said spindle having a cylindrical base surface resting and riding upon the cylindrical surface of said groove;

at least one spring supported on a first side of said spindle which faces a first hook-like wall edge;

a clamping element formed at one end of said at least one spring disposed adjacent to said first hook-like edge of the plate cylinder surface for engaging the front end of the printing plate against one of said hook-like groove edges; and a rigid bar disposed on the opposite side of the spindle axis and rigidly mounted on said spindle, said bar having an end terminating adjacent to the plate cylinder surface for receiving the hook-like bent rear end of the printing plate, said bar being directed toward the printing plate front end, so that when the spindle is pivoted on its axis, the extending end of said bar will engage said clamping element, and, in turn, urge the clamping element against the first hook-like edge of said groove, so that said front end and said rear end of said printing plate may be securely clamped between said first hook-like edge of said groove and said clamping element, and between said clamping element and said bar, respectively.

2. Device according to claim 1, wherein said spindle is provided with flat side portions for mounting said at least one spring and said bar.

* * * * *